US007101592B2

(12) United States Patent
Gueggi et al.

(10) Patent No.: US 7,101,592 B2
(45) Date of Patent: Sep. 5, 2006

(54) METHOD AND APPARATUS FOR CURTAIN COATING

(75) Inventors: Markus Gueggi, Marly (CH); Sedat Varli, Reichenburg (CH)

(73) Assignee: Dow Global Technologies Inc., Midland, MI (US)

( * ) Notice: Subject to any disclaimer, the term of this patent is extended or adjusted under 35 U.S.C. 154(b) by 0 days.

(21) Appl. No.: 10/496,997

(22) PCT Filed: Dec. 12, 2002

(86) PCT No.: PCT/US02/39941

§ 371 (c)(1),
(2), (4) Date: May 27, 2004

(87) PCT Pub. No.: WO03/053597

PCT Pub. Date: Jul. 3, 2003

(65) Prior Publication Data

US 2004/0265496 A1 Dec. 30, 2004

Related U.S. Application Data

(60) Provisional application No. 60/340,714, filed on Dec. 13, 2001.

(51) Int. Cl.
*B05D 1/30* (2006.01)
*B05C 5/00* (2006.01)

(52) U.S. Cl. ..... 427/420; 427/294; 427/299; 118/324; 118/50; 118/68; 118/DIG. 4

(58) Field of Classification Search ..... None
See application file for complete search history.

(56) References Cited

U.S. PATENT DOCUMENTS 3,508,947 A 4/1970 Hughes ..... 117/34

(Continued)

FOREIGN PATENT DOCUMENTS

EP 0 489 978 B1 6/1992

(Continued)

*Primary Examiner*—Katherine Bareford

(57) ABSTRACT

In a method and an apparatus for curtain coating of a moved substrate like a paper web substrate is moved below a liquid supply means providing a single or multilayer liquid coating in the form of a free-falling curtain impinging the substrate at a dynamic wetting line and a blade or air shield located upstream of the dynamic wetting line with respect to the moving direction of the substrate. The dynamic wetting line of the coating curtain on the substrate or web is oriented generally perpendicular to the moving direction of the substrate or web, providing substantially the same air pressure over an essential part of the coating curtain on its front and back side with respect to the moving direction of the substrate and providing a first supply air flow upstream to the wetting line. The supply air flows over a substantial length along the free-falling curtain and evacuates air from a location upstream of the supply air flow so that the air near the dynamic wetting line is moved against the moving direction of the substrate web and the boundary air layer entrained to the substrate. A second supply air is provided in proximity to the wetting line.

20 Claims, 5 Drawing Sheets

U.S. PATENT DOCUMENTS

| | | | | |
|---|---|---|---|---|
| 5,206,057 | A | 4/1993 | Finnicum et al. | 427/420 |
| 5,224,996 | A * | 7/1993 | Ghys et al. | 118/325 |
| 5,624,715 | A * | 4/1997 | Gueggi et al. | 427/420 |
| 5,976,630 | A | 11/1999 | Korokeyi et al. | 427/420 |
| 6,146,690 | A | 11/2000 | Kustermann | 427/8 |
| 6,162,502 | A | 12/2000 | Schweizer et al. | 427/294 |
| 6,524,388 | B1 * | 2/2003 | Yamada et al. | 118/663 |

FOREIGN PATENT DOCUMENTS

| | | | |
|---|---|---|---|
| EP | 1 142 647 | A | 10/2001 |
| JP | 09 141170 | A | 10/1997 |
| JP | 2001-300386 | * | 10/2001 |
| WO | WO 01/16427 | A1 | 3/2001 |

* cited by examiner

METHOD AND APPARATUS FOR CURTAIN COATING

CROSS REFERENCE TO RELATED APPLICATIONS

This application is a 371 of PCT/US02/39941 filed Dec. 12, 2002, which claims the benefit of U.S. Provisional application Ser. No. 60/340,714, filed Dec. 13, 2001.

FIELD OF THE INVENTION

The present invention relates to a method and apparatus for curtain coating of a continuously moving substrate with one or more simultaneously applied layers of liquid coating materials, and, more particularly to a method and apparatus for curtain coating involving a blade or air shield located upstream of a curtain with respect to the moving direction of the substrate.

BACKGROUND OF THE INVENTION

Mainly in the field of manufacture of photographic papers or coated films, curtain coating methods and apparatus are widely known and used. Typically a continuous web or sheets are continuously moved below a coating hopper. One or more liquid compositions are provided from a hopper arrangement in the form of a liquid curtain.

For the manufacture of photographic papers, liquid compositions are used of relatively low viscosity, generally less than about 150 cP (centipoise), most in the range from about 5 to about 100 cP.

The manufacture of photographic papers is a tremendously difficult art requiring extremely accurate control. The practical use of curtain coating provides a number of difficulties coming with a need for an extremely uniform coating on the one hand and a need for coating of substrates in form of a continuous web at high speeds on the other hand.

A number of problems associated with curtain coating have been addressed in the prior art and many proposals have been made to overcome such problems.

Besides obtaining a free-falling curtain having uniform curtain characteristics over its width perpendicular to the moving direction of the substrate, one of the most often addressed problems for coating at speeds higher than approximately 150 m/min is the displacement or deformation of the curtain by the air which is carried along the uncoated substrate due to friction. That air is carried along with the moving substrate to the coating point which designates the location where the coating liquid first contacts the substrate. In the curtain coating process this location has the form of a line across the substrate and is referred to as the dynamic wetting line. The area near the substrate where the air is in motion due to friction is called the boundary layer.

In the prior art a number of problems are described with respect to the air boundary layer.

One of these problems described for instance in U.S. Pat. No. 6,162,502 A is that air is entrained between the substrate and the liquid film and no coherent coating will be obtained at increased coating speeds.

Even if the air is not entrained between the substrate and the liquid film, the air strikes the curtain in the direction of motion of the substrate with considerable force, especially in the case of high-coating speeds. This leads to disturbances mainly in the area of the dynamic wetting line which cause diffused irregularities in the coated film, as described e.g. in U.S. Pat. No. 6,162,502 A and EP 0 489 978 B1.

Two main effects have been observed in the past in view of the boundary layer hitting a curtain. One is that the air layer hits the contact line between the curtain and the web. As the air needs to reverse its flow direction, the displacement of the wetting line is not uniform over the length over the curtain, and the curtain assumes a wavelike or undulating deformation across the web substrate. As a consequence of the curtain deformation the coated layer gets areas of varying thickness of the coating, which means that the coated layer gets band like thickness deviations along the moving direction of the web.

Another effect is that the curtain is blown up in the direction of the motion of the substrate like a balloon. This results not only in deformation of the wetting line but also results in an irregular coating behavior of the curtain transversely to the coating direction and the momentum of the air or the pressure difference over the curtain may temporarily slit the curtain, thus inducing streaks in the coating.

In a curtain coater arrangement involving an air shield located between a roller for supporting and forwarding the substrate a number of methods are known for mitigating the detrimental effect of boundary layer air. One approach is reported in U.S. Pat. No. 3,508,947 to Hughes where the minimization of entrained air on the moving web is proposed by use of an air shield that has been provided with a vacuum manifold which is positioned adjacent to the web to be coated and connected to a vacuum pump to withdraw air therefrom. In this manner Hughes proposes that the multilayer, free-falling vertical curtain of coating material is shielded from ambient air currents and the air entrained by the moving web is drawn off before the curtain impinges on the moving web at the wetting line.

U.S. Pat. No. 5,976,630 reports a more recent curtain coating practice employing the air shield mainly for the purpose of drawing off air entrained by the moving web as opposed to shielding the free-falling curtain from ambient air currents. This is because curtain coating operations typically include an enclosure to shield the free-falling liquid curtain from ambient air currents. The enclosure is continuously supplied with a laminar low velocity air flow from the top, while at the same time air is exhausted from both the front and rear of the enclosure. It is known that air shield systems employing a single manifold and a single vacuum source have been operated to exhaust higher air volumes in an attempt to remove additional air from behind the free-falling curtain as well as air entrained on the web.

U.S. Pat. No. 5,224,996 to Ghys et al. is reported to teach an alternative design for a curved air shield arrangement close to a backing roller which supports the moving web at the point of impingement. The design taught for the air shield provides for increased resistance to air flow in the gap between the air shield and the backing roller at the end and side regions thereof as compared to air flow resistance at an intermediate region of the shield. The vacuum device communicates with the gap in the intermediate region to reduce air pressure therein. In such manner, there is an improved removal of boundary layer air at the surface of the moving web prior to the impingement point or wetting line which apparently allows a better coating quality at increased speed of the moving web.

EP 0 489 978 B1 further describes additional arrangements to increase the air resistance by further means like protruding parts, strips or even one or more laminae connected to the air shield and directed towards the web. The laminae are taught to extend over the total width of the air shield or a group of smaller randomly placed laminae. The aim which should be reached by such an arrangement is described to obtain a reduced pressure with a low flow rate of evacuated air. Higher flow rates are reported not to be desirable since they can cause non-uniformities inside the air shield. Such non-uniformities are reported to cause band-like disturbances in the coated material.

EP 0 489 978 B1, the disclosure of which is hereby incorporated by reference, further reports that the pressure difference between the ambient air and the inside of the air shield has to be high enough to evacuate the boundary layer of air adhering to the web, but needs to be limited to avoid an air flow in a direction from the coating curtain towards the air shield, that is against the moving direction of the web. It is reported that an air flow from the coating curtain towards the air shield may cause the entire liquid curtain or at least a part of it to become sucked up into the air shield, therefore destroying the coating procedure, which is to be avoided under any circumstances.

Further, it is described to arrange the outlet end of the air shield at a distance between 5 and 30 mm upstream of the wetting line, because smaller distances involve the risk for a swinging curtain to touch and to soil the air shield, thereby interrupting the coating process, whereas larger distances strongly reduce the effect of the air removal and allow rebuilding of a new boundary layer of entrained air.

U.S. Pat. No. 5,976,630 to Korokeyi et al. proposes use two different intake slots in combination with an air shield which slots are connected to one common or two separate vacuum pumps, wherein one air intake slot is dedicated to removing the entrained boundary air layer of the moving substrate and one is dedicated to the removal of the entrained boundary air layer of the free-falling curtain. Further it is proposed to provide fresh, filtered, optionally heated, laminar, low velocity air flow having a speed of about 10 to about 20 ft/mm (about 5 to about 10 cm/s) which is supplied to the enclosure surrounding the free-falling curtain through an upper perforated wall thereof It is further mentioned that the free-falling curtain is to be supplied with fresh air as spent air as withdrawn from the enclosure surrounding the apparatus through exhaust ports in the enclosure. The exhaust ports are described essentially to remove the supplied air to minimize pressure differential across the free-falling curtain. The teaching of U.S. Pat. No. 5,976,630 is intended to reduce or avoid circulation or vortex pattern of air currents along the curtain which is known to cause disturbances in the curtain which in turn can lead to streaks in the coated product.

U.S. Pat. No. 6,146,690 to Kustermann describes an arrangement for curtain coating for instance of a paper web which should prevent forming of air bubbles by parts of a boundary air layer entrapped between the substrate and the coating applied in an amount making the coated product economically unusable at coating conditions where the web has a width up to 4 m and coating speeds at up to 1000 m/min. To achieve this goal, it is proposed to locate a dynamic air pressure sensor in close proximity to the wetting line where a coating medium contacts the material web surface, and where an increased dynamic pressure relative to the normal air pressure should be observable caused by the boundary air layer entrained to the substrate web. The dynamic pressure signal is compared to a predetermined dynamic pressure value and a suction device to remove air entrained to the substrate web and/or the coating curtain is controlled to maintain a predetermined dynamic pressure value near the wetting line on the substrate.

In a further embodiment of the invention described it is proposed to provide a scraper bar for removal of the air entrained with a moving surface of the substrate located upstream from the wetting line to reduce the mechanical power needed for the suction device, and, further, it is suggested to engage an additional suction device producing a partial vacuum on the side of the substrate web facing away from the coating curtain pulling the substrate web against a support element like a backing roll.

U.S. Pat. No. 6,162,502 to Schweizer et al. proposes to engage a suction channel and an air supply channel within an air shield, both engaging a porous layer towards the substrate web. The air supply channel is arranged between the layer suction channel and the dynamic wetting line and the air supply is proposed to be adjusted in function of the extracted air in such a manner that a parabolic velocity profile develops providing an air velocity equal to zero between the air shield and the substrate with the aim to prevent any air flow in front of the wetting line where the coating curtain strikes the substrate. It is pointed out to be important that the air volume to be extracted is not drained from the space between the air shield and the curtain which needs to be avoided according to the teaching of this patent to prevent from any disturbing air flows in front of the curtain.

U.S. Pat. No. 5,624,715 to Gueggi et al. proposes to extract any air entrained with a moving substrate via a slot at the edge of a blade oriented towards the curtain so that the size of the remaining boundary layer striking the curtain is minimized. Further, an air supply opening is proposed at the underside of a lip of the curtain hopper to provide air to this point at a low speed and downwardly deflected, which low speed air flow is also evacuated by the slot of the blade arranged at the edge of the blade facing towards the curtain. By these measures the formation of rotating air turbulences between the blade and the curtain should be avoided which otherwise may divide into individual unstable cells causing the curtain becoming disturbed and unsteady and, consequently, results in a reduced coating quality.

WO 01/16427 A1 assigned to Valmet Corp. proposes a curtain coater with a conventional doctor arrangement upstream in the travel direction of a web substrate in front of an impingement point of the coating mix curtain on the surface of the web. According to the teaching of this document, besides provision of an usual evacuating means within the doctoring means, it is proposed to increase the momentum of the coating mix curtain by making the height of the falling curtain larger and thereby increasing falling velocity so that the coated liquid becomes more energetic to penetrate through the boundary air layer travelling on the web surface. More particularly it is proposed to provide a gas-injection nozzle downstream from the curtain supplying a significant stream of gas, including air or steam, towards the coating curtain near the wetting line so that the combined momentum of the coating mix curtain and the gas jet becomes sufficiently energetic to force the coating mix to penetrate through the boundary air layer travelling on the web surface and thus, the curtain can unobstructedly adhere to the surface of the web.

Although many approaches have been made in the prior art to overcome the drawbacks and problems coming with the use of a curtain coating process, in particular at high coating speeds, there are still remaining drawbacks effecting the quality and cost effectiveness of curtain coating methods, in particular with respect to curtain coating of paper substrates.

SUMMARY OF THE INVENTION

It is therefore an object of the invention to provide an improved curtain coating method and apparatus particularly for high-speed coating of a paper web substrate, more particularly for high-speed coating of a continuous paper web substrate, more particularly in connection with a coating liquid having a relatively high viscosity compared to the coating liquids used for the manufacture of photographic papers, that has a low shear viscosity of generally well above 1.5 Pa·s.

Briefly stated, these and other features, objects and advantages are obtained by providing a method for curtain coating of a moved substrate like a paper web wherein said substrate is moved below a liquid coating supply means providing a single or multilayer liquid coating in the form of a free-falling curtain impinging the substrate at a dynamic wetting line and a blade or air shield located upstream of the dynamic wetting line with respect to the moving direction of the substrate, wherein the dynamic wetting line of the coating curtain on the substrate is oriented generally perpendicular to the moving direction of the substrate, providing substantially the same air pressure over an essential part of the coating curtain on its front and back side with respect to the moving direction of the substrate, providing a first supply air flow upstream to the wetting line wherein the supply air flows over a substantial length along the free-falling curtain, and evacuating air from a location upstream of the supply air flow so that the air near the dynamic wetting line is moved against the moving direction of the substrate and the boundary air layer entrained to the substrate, wherein a second supply air is provided in proximity to the wetting line.

With the provision of a second supply air in the near or proximity to the wetting line it is possible to provide an improved curtain coating method, particularly for high-speed coating of a paper web substrate. With the additional supply air it is possible to maintain a stable and good curtain. This can be reached by controlling the first and second supply air and by evacuating the air from the wetting line in the proposed manner.

As liquid supply means preferably a hopper means can be used.

Preferably the speed of the supplied air in a direction against the moving speed of the substrate web in a gap between the down stream edge of the air shield and a suction opening or channel of the air shield is greater than the moving speed of the web, more preferably about twice the moving speed still more preferably more than three times the moving speed of the substrate web.

Preferably, the amount of air sucked off the substrate equals the amount of air entrained to the boundary layer of the substrate web plus the amount of air entrained in the boundary layer of the curtain plus the amount of air supplied near the dynamic wetting line by supply means.

In preferred embodiments of the method according to the invention the moving speed of the substrate is above 1000 m/min, preferably in a range of about 1200 m/min to about 3000 m/min.

In a further preferred embodiment of the method the air speed of air inlet for suction or vacuum means exceeds double the speed value of the moving substrate in opposite direction and more preferably exceeds 120 m/s with respect to the blade or air shield, to about 200 m/s.

In preferred embodiments the amount of air supplied near the dynamic wetting line is about 60 to 80 l/s per one meter of substrate width at a gap between the blade or air shield and the uncoated substrate of about 1 mm.

In another preferred embodiment of the method the amount of supplied air is approximately 2 to 20, more preferred about 5 to 12 times the amount of air entrained in the boundary layer of the free-falling curtain, more preferably in the range of 8 to 10 times.

In a further preferred embodiment of the invention, the method comprises the provision of an air flow sensor in a passageway between a chamber provided on the upstream side of the coating curtain and ambient air, and controlling the amount of air supplied in proximity of the dynamic wetting line in response to the output of the air flow metered between ambient air and the upstream side of the coating curtain to zero.

An apparatus according to the invention involves means for moving of a substrate to be coated like a paper web wherein said substrate is moved through a curtain coater, comprising an arrangement with a liquid coating supply means, preferably a hopper means for providing a free-falling curtain of coating liquid, with a blade or air shield means to provide a small gap between the substrate and said blade or air shield, with a first air supply opening extending generally over the width of the substrate providing a first air flow in the region of the dynamic wetting line where the liquid coating curtain impinges on the substrate, and with a suction or vacuum providing means connected to said blade or air shield arranged to remove air from said gap between the substrate and said blade or air shield wherein the arrangement comprises a second air supply flow with an air supply outlet in proximity to the wetting line.

Preferably, the arrangement comprises a guide member directing the supplied air flow towards the dynamic wetting line without hitting most of the coating curtain area.

In a preferred embodiment of the invention the hopper means is located generally above a backing roller and wherein said blade or air shield means is arranged near said backing roller.

More preferably an air chamber is located on the upstream side of the coating curtain with respect to the moving direction of the substrate and arranged between the guiding member and the hopper means, further comprising an opening connecting the chamber with ambient air space.

Preferably, a flow sensor is arranged within the opening connecting the chamber with ambient air providing an air flow signal to control means for controlling air supply means so that the amount of air supplied in proximity to dynamic wetting line is controlled such that the air flow sensed by the air flow sensor tends to zero.

In a preferred embodiment of the invention the upstream end of the air shield comprises a labyrinth type sealing in the gap between the air shield and the substrate and/or near the end of the air shield facing towards the coating curtain on both sides of the air shield.

DETAILED DESCRIPTION OF THE INVENTION

Figure 1:
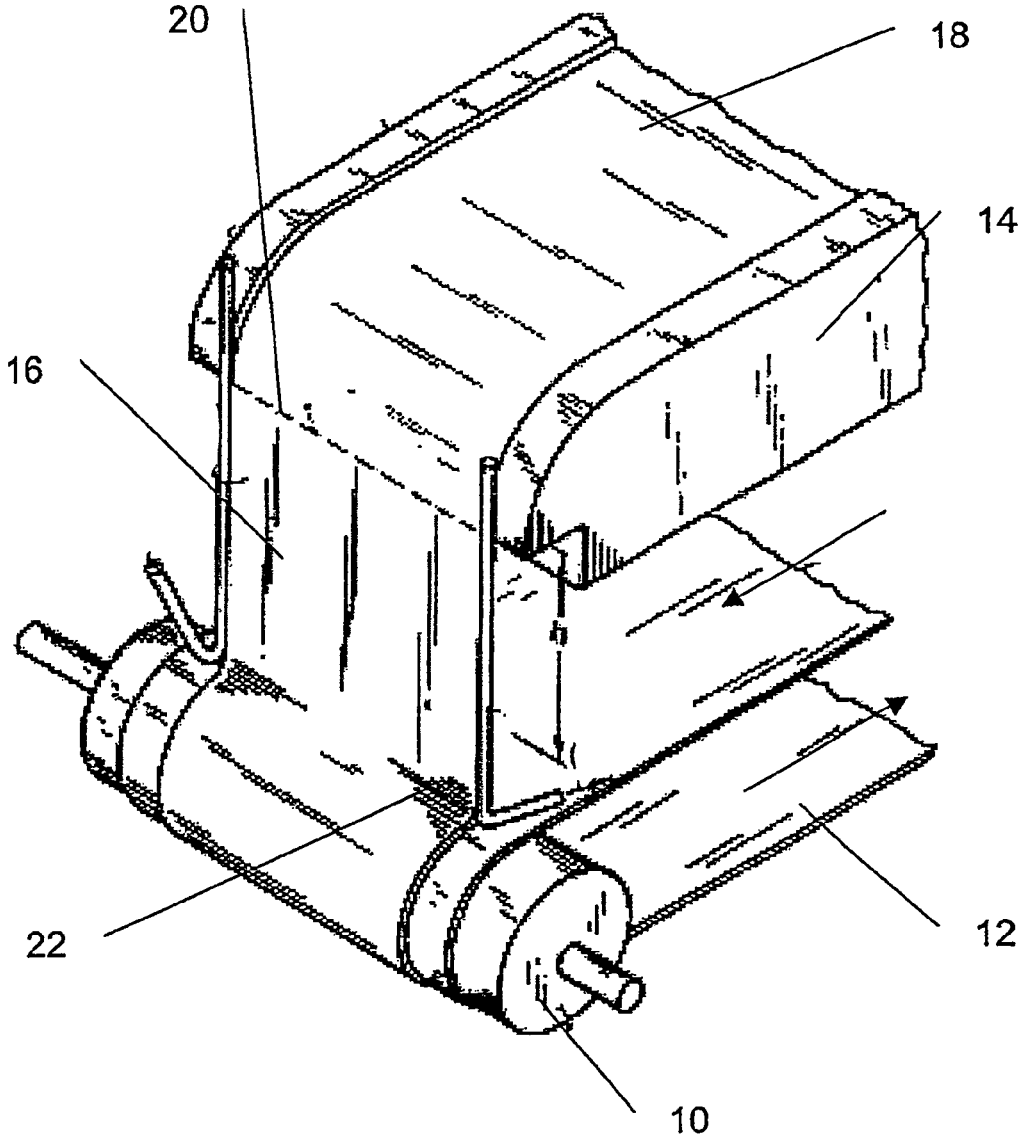
(PRIOR ART) FIG. 1
FIG. 1 is a schematic overview showing generally a curtain coater arrangement as known from the prior art.

FIG. 1 shows the main parts of a curtain coater as known from the prior art and generally involved with an improved method and apparatus according to this invention. A conventional curtain coater has means, preferably in form of a backing roller 10, for forwarding separate sheets or a continuous web 12 as a substrate to be coated. The web 12 which may comprise a paper, is forwarded along the backing roller 10 through the curtain coater. A hopper means 14 as a liquid coating supply means is located generally above the backing roller 10. Various forms of hopper means 14 are known, generally providing a curtain 16 of a coating liquid 18 free falling over a distance h forwarded over a lid 20 or any other suitable means. Instead of a hopper means 14 also any other means for supplying the coating liquid can be used; i.e. a slot die or curtain die.

The coating curtain 16 is moved towards the substrate 12 on the backing roller 10 by gravity force and impinging on the substrate web 12 along a line 22 generally perpendicular to the moving direction of the substrate 12. The line 22 is generally below the lid 20 but moving relatively to the substrate web 12 when in motion and therefore called the dynamic wetting line 22.

For the purpose of this application, the area of the curtain coater orientated in a direction where the substrate web 12 is uncoated before reaching the dynamic wetting line 22 is called "upstream", whilst the area where the substrate web 12 is located after being coated at the dynamic wetting line 22 is called "downstream".

Figure 2:
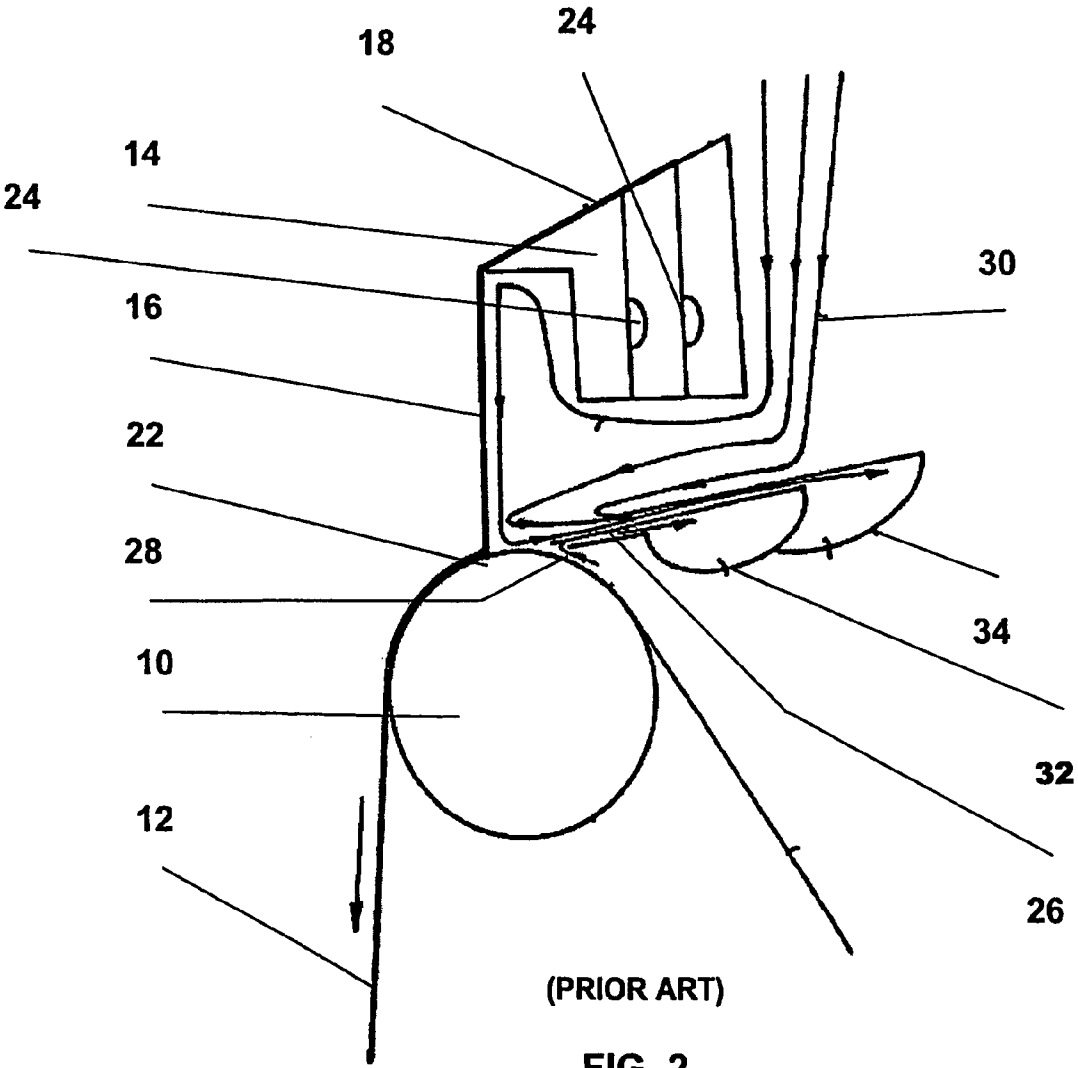
(PRIOR ART) FIG. 2
FIG. 2 is a schematic view of a curtain coater arrangement providing for a laminar, low velocity air flow along a free-falling coating curtain as well as dedicated vacuum sources for air entrained to the curtain and air entrained to the substrate web, respectively.

FIG. 2 schematically depicts a more sophisticated arrangement from the prior art providing a hopper means 14 for providing a multi-layer coating film provided from several sources 24 of coating liquid 18. Air shield means 26 are provided adjacent to the backing roller 10 and the coating curtain 16 enclosed to the surface of the substrate web 12 to be coated. In this prior art arrangement, dedicated air inlets are provided for the boundary air layer, indicated by arrow 28, entrained with the substrate web 12, and an air flow indicated by arrows 30 flowing along the curtain 16 to vacuum sources 32 and 34, respectively.

The curtain coater arrangement shown is enclosed in a housing having openings for providing air flow 30 as well as openings for draining excess air to the environment. Encapsulating of the curtain coater is desired to reduce impact on the coating curtain 16 caused by ambient air currents.

Figure 3:
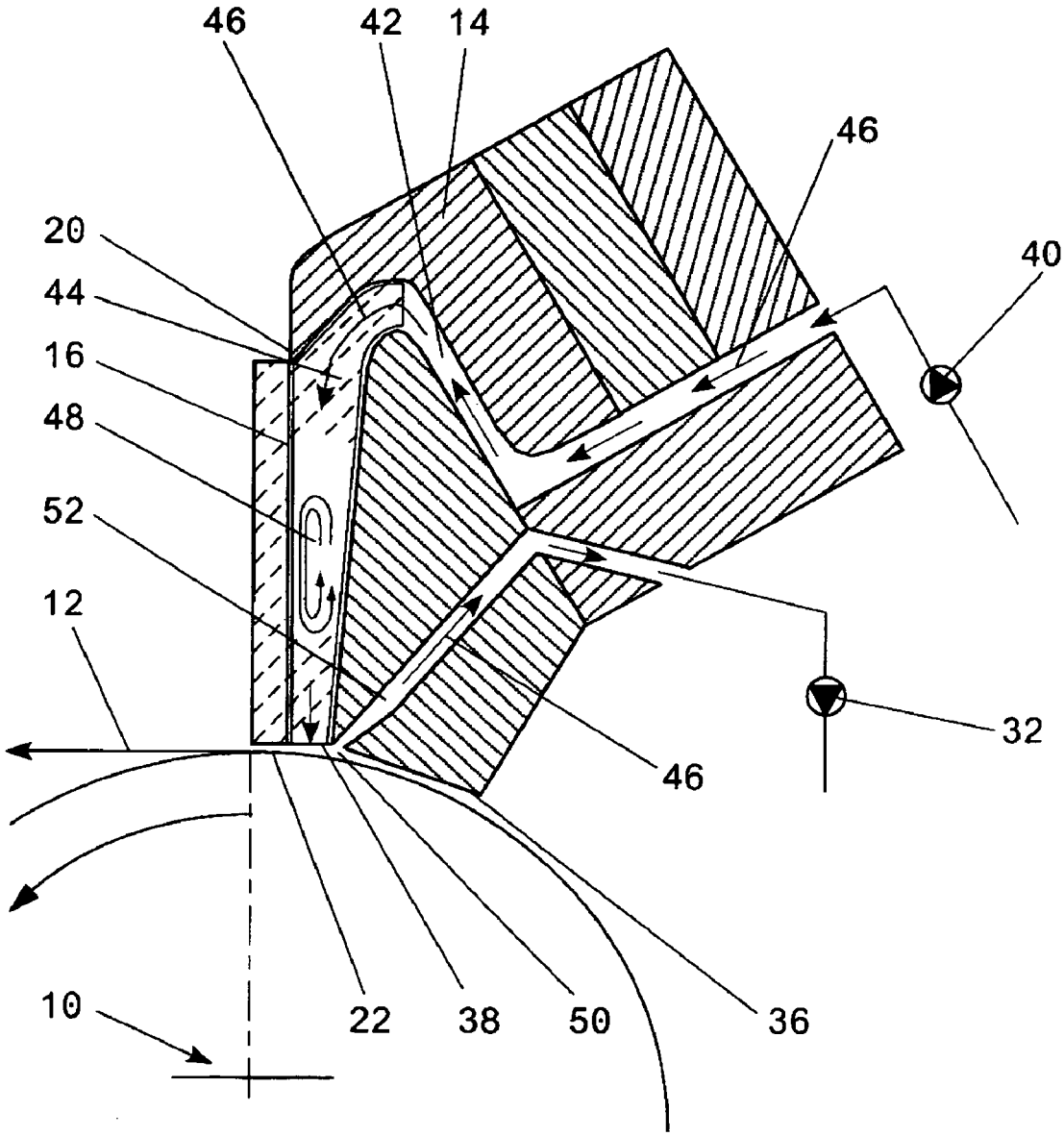
FIG. 3 (PRIOR ART)
FIG. 3 is a schematic cross sectional view of a curtain coater air shield arrangement providing for a vacuum source as well as an air supply near a coating curtain.

FIG. 3 schematically shows an arrangement of an air shield means 26 near the dynamic wetting line 22 of a curtain coater. A small gap 36 is provided between the air shield 26 and the substrate 12 on the backing roller 10. Near the edge 38 of the air shield 26 facing towards the coating curtain 16 is arranged an air inlet 50 connecting the gap 36 with a vacuum pump 32 for extracting air entrained with a web substrate 12 to reduce the boundary air layer.

Additionally, a first air flow is provided by an air supply means 40 through channel 42 into a chamber 44 formed on the upstream side of the curtain 16 approximately from the web surface 12 at the bottom to lid 20 of the hopper means 14 at the top. The first supply air flow depicted by arrows 46 is dedicated to reduce disturbances of the coating curtain 16 by providing an air flow travelling along the falling direction of the curtain 16 to prevent forming of vortex or circular flow patterns 48 within the chamber 44. The first air flow 46 is also sucked off by the vacuum pump 32 through opening 50 and vacuum channel 52.

Figure 4:
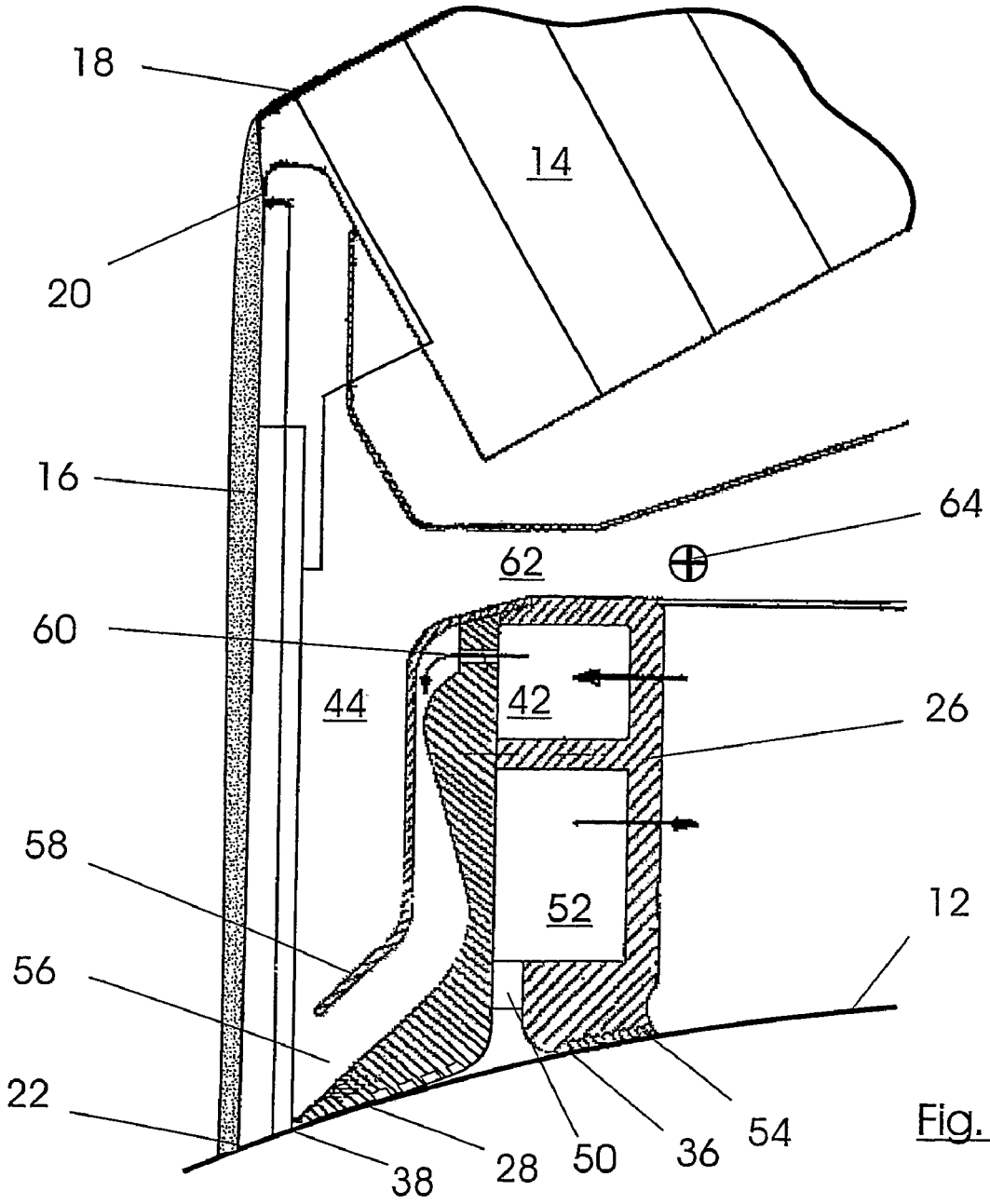
FIG. 4 is a schematic review of an improved curtain coating apparatus according to a preferred embodiment of the invention in a cross sectional view.

The curtain coating apparatus according to the invention is shown in a cross sectional view in FIG. 4. Parts being the same or similar to those described above are depicted by the same reference number for the ease of understanding. A backing roller 10 having a diameter of about 200 mm to 1500 mm depending on the width of the web moves the continuous web of coating substrate 12, generally paper, at a speed of 20 to 40 m/s. An air shield 26 is arranged above the backing roller 10 providing an air gap 36 between the air shield 26 and the substrate of about 1 mm, maybe in the range of 0.5 to 3 mm, preferably 1 to 2 mm.

In the upstream region of the air shield 26 is provided a labyrinth type sealing 54 extending in cross direction of the moving web, i.e. parallel the back side of the air shield 26. The labyrinth type sealing 54 is very effective with respect to removal of a boundary air layer 28 entrained with the moving web. This is not only because of the sealing effect of such labyrinth type sealing, but because of breaking up the boundary air layer due to the pressure and air flow speed variation by vortex forming and reduction of kinetic energy of the air flow within the labyrinth chambers. A similar arrangement may also be useful in the gap between the downstream edge 38 of the air shield 26 facing towards the coating curtain 16 and the air inlet or suction opening 50 of the air shield 26. Additionally in the two side-plates of the air shield 26 a labyrinth sealing is possible to avoid an escape of air at right angles to the moving direction of the substrate or web 12.

In close proximity to the wetting line 22 and the downstream edge 38 of the air shield 26 is arranged a supply air outlet 56 for providing a second air supply flow towards the downstream edge 38 of the air shield. The upstream side of the coating curtain 16 is shielded by a guide member 58 to ensure that the second supply air flow 60 from a supply air source, not shown, via supply air manifold 42 does not hit or disturb the free-falling curtain 16 along most of its height.

A vacuum pump (not shown) is connected to a vacuum air manifold 52 with an air inlet or suction opening 50 arranged between the upstream labyrinth type sealing 54 of the air shield 26 and the downstream edge 38 of the air shield 26 for evacuating air from the gap 36 between the air shield 26 and the substrate web 12. The vacuum pump is capable of removing not only the amount of air from the boundary air layer entrained with the moving web 12 but also for removing the boundary air layer entrained with the free-falling curtain 16 and the second air flow 60 provided through the air supply opening 56 of the air shield 26.

An air chamber 44 is provided upstream of the coating curtain 16 and between the guiding member 58 of the air shield 26 and the hopper means 14. The chamber 44 has an opening 62 between the hopper means 14 and the air shield 26 allowing free flow of air as the first air supply flow between the chamber 44 and the ambient air space. Generally, it is desirable to maintain ambient air pressure within the chamber 44 being the same air pressure on the downstream side of the coating curtain 16, thus, preventing the curtain 16 from being blown up or pulled back.

Within the opening 62 an air flow sensor 64 is arranged for detecting any air flow from ambient air space to the chamber 44 or vice versa. A signal corresponding to an air flow detected is provided from the sensor 64 to a control means not shown, controlling the air supply means and thus the supply air flow 60 towards the dynamic wetting line 22. Due to the fixed geometry of the gap 36 in the downstream edge region 38 of the air shield 26, any variation in the supply air flow 60 increases or decreases the air pressure within the chamber 44 and, thus, controlling the air flow towards a zero air flow signal of sensor 64 provides controlling the air pressure within the chamber 44 to ambient air pressure without forming of remarkable air flow on the upstream side of the curtain 16, thus, avoiding any disturbances of the coating curtain 16.

The design of the air shield 26 and the supply air system is designed to obtain a very high air flow speed within the gap 36 from the downstream edge 38 of the air shield 26 against the moving direction of the web 12 towards the suction opening 52 of the air shield 26. Under preferred operating conditions the air speed within the gap 36 is at least twice the figure of the moving speed of the web 12, preferably as high as possible, up to about 200 m/s.

Figure 5:
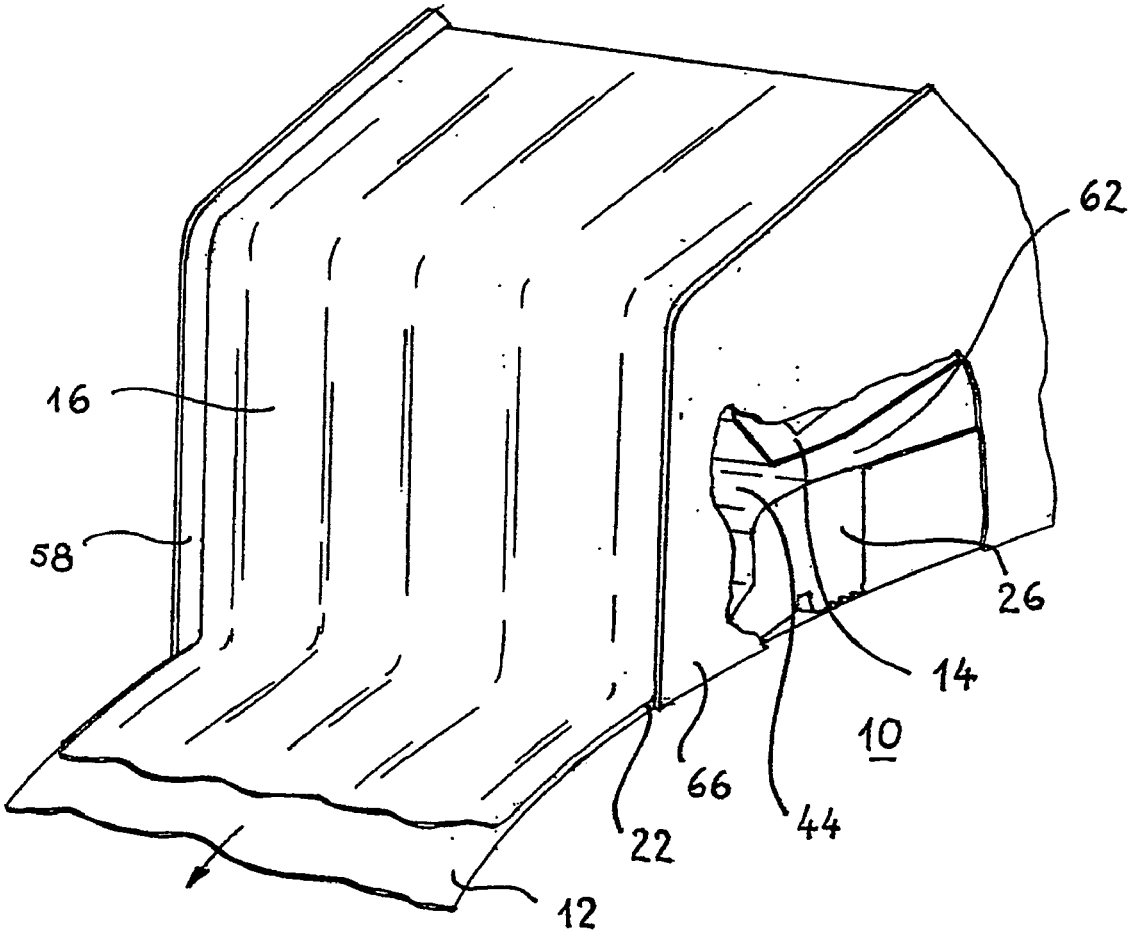
FIG. 5 is a simplified perspective view of the curtain coater arrangement of an embodiment of the invention.

To essentially seal the chamber 44 to have the opening 62 as the only practical connection of the chamber 44 to the ambient air space, side plates 66 are provided on both sides of the curtain coater, as shown in FIG. 5, to cover chamber 44, air shield 26, and at least part of the hopper means 14 in a direction perpendicular to the moving direction of the web 12, to enable proper operation as described above.

For a web width of about 570 mm and a gap 36 between the air shield 26 and the substrate 12 of about 1 mm and a moving speed of a substrate web 12 of 20 to 40 m/s providing an supply air flow 60 in an amount of about 40 l/s and removal of air flow of about 51 l/s through the vacuum pump have been found to provide excellent results in removing the boundary air layer entrained with both the substrate web 12 as well as the free-falling coating curtain 16 at an air speed in the gap 36 of about 125 m/s, thus, practically removing the boundary air layer to as little as possible.

Besides the excellent coating results at coating speeds well above those previously used for curtain coating the method and apparatus according to the invention provides excellent operating behavior without the necessity of complicated and sophisticated control means and is therefore much easier to use and not only assumed to be more reliable compared to the prior art but in any way much more cost effective.

Where this invention has been described in terms of a preferred embodiment, the present invention can be further modified within the spirit and the scope of this disclosure. This application is therefore intended to cover any variations such as encapsulations of the downstream side of the curtain, uses or adaptations of the invention using its general principles. Further, this application is intended to cover such departures from the present disclosure as come within known or customary practice in the art to which this invention pertains and which fall within the limits of any claims directed to this invention.

The invention claimed is:

1. A method for curtain coating of a moved substrate wherein said substrate is moved below a liquid coating supply means providing a single or multilayer liquid coating in the form of a free-falling curtain impinging the substrate at a dynamic wetting line and a blade or air shield located upstream of the dynamic wetting line with respect to the moving direction of the substrate, wherein the dynamic wetting line of the coating curtain on the substrate is oriented generally perpendicular to the moving direction of the substrate, providing substantially the same air pressure over the coating curtain on its front and back side with respect to the moving direction of the substrate, providing a first supply air flow upstream to the wetting line wherein the supply air flows over a substantial length along the free-falling curtain, and evacuating air from a location upstream of the supply air flow so that the air near the dynamic wetting line is moved against the moving direction of the substrate and a boundary air layer entrained to the substrate, characterised in that a second supply air flow is provided in proximity to and upstream of the wetting line, so that the first and second supply air flows are provided between the curtain and any blade or air shield.

2. The method according to claim 1, wherein as said liquid coating supply means a hopper means is used.

3. The method according to claim 1, wherein the speed of air supply in a gap between a down stream edge of the air shield and a suction opening of the air shield is greater than the speed of the substrate.

4. The method according to claim 3, wherein the speed of said air supply in said gap is about twice the speed of the substrate.

5. The method according to claim 3, wherein the air speed of said air supply in said gap exceeds double the speed of the moving substrate in opposite direction.

6. The method according to claim 1, wherein the moving speed of the substrate is above 1000 m/min.

7. The method according to claim 1, wherein the moving speed of the substrate is in a range of about 1200 m/min to about 3000 m/min.

8. The method according to claim 1, wherein the amount of air supplied near the dynamic wetting line is about 60 to 80 l/s per one meter of substrate width at a gap between a down stream edge of said blade or air shield and a suction opening of the air shield wherein the height of the gap between the uncoated substrate and said blade or air shield is about 1 mm.

9. The method according to claim 1, wherein the amount of supplied air is approximately 2 to 20 times the amount of air entrained in the boundary layer of the free-falling curtain.

10. The method according to claim 9, wherein the amount of supplied air is approximately in the range of 8 to 10 times the amount of air entrained in the boundary layer of the free-falling curtain.

11. The method according to claim 1, wherein an air flow sensor is provided in a passageway between a chamber on the upstream side of the coating curtain and said first ambient air supply, which first air supply is ambient air, the method further comprising controlling the amount of second supply air supplied in proximity to the dynamic wetting line in response to the output of the air flow sensor.

12. A method for curtain coating of a moved paper web substrate wherein said substrate is moved below a liquid coating supply means providing a single or multilayer liquid coating in the form of a free-falling curtain impinging the substrate at a dynamic wetting line and a blade or air shield located upstream of the dynamic wetting line with respect to the moving direction of the substrate, wherein the dynamic wetting line of the coating curtain on the substrate is oriented generally perpendicular to the moving direction of the substrate, providing substantially the same air pressure over the coating curtain on its front and back side with respect to the moving direction of the substrate, providing a first supply air flow upstream to the wetting line wherein the supply air flows over a substantial length along the free-falling curtain, and evacuating air from a location upstream of the supply air flow so that the air near the dynamic wetting line is moved against the moving direction of the substrate and a boundary air layer entrained to the substrate, characterised in that a second supply air flow is provided in proximity to and upstream of the wetting line, so that the first and second supply air flows are provided between the curtain and any blade or air shield, and that the speed of air supplied in a gap between the substrate and said blade or air shield is at least about twice the speed of the substrate.

13. An apparatus with means for moving of a substrate to be coated wherein said substrate is moved through a curtain coater, comprising an arrangement with liquid coating supply means for providing a free-falling curtain of coating liquid, with a blade or air shield means provided upstream of said curtain to provide a small gap between the substrate and said blade or air shield, with a first air supply opening extending generally over the width of the substrate providing a first air flow in the region of the dynamic wetting line where the liquid coating curtain impinges on the substrate, and with a suction or vacuum providing means connected to said blade or air shield arranged to remove air from said gap between the substrate and said blade or air shield characterised in that the arrangement comprises a second air supply flow with an air supply outlet in proximity to, and upstream of, the wetting line, so that the first and second supply air flows are provided between the curtain and any blade or air shield.

14. The apparatus according to claim 13, wherein the liquid coating supply means is a hopper means.

15. The apparatus according to claim 13, wherein the arrangement comprises a guide member directing said second supply air flow towards the wetting line.

16. The apparatus according to claim 14, wherein said hopper means is located generally above a backing roller and wherein said blade or air shield means is arranged near said backing roller.

17. The apparatus according to claim 15, wherein an air chamber is located on the upstream side of the coating curtain with respect to the moving direction of the substrate and is arranged between said guide member and said hopper means, further comprising said first air supply opening connecting the chamber with ambient air space for the first air supply.

18. The apparatus according to claim 17, wherein a flow sensor is arranged within said first air supply opening connecting the chamber with ambient air providing an air flow signal to control means for controlling air supply means.

19. The apparatus according to claim 13, wherein the upstream and/or downstream end of the air shield comprises a labyrinth type sealing in a gap between the air shield and the substrate.

20. The apparatus according to claim 13, wherein near the end of the air shield facing towards the coating curtain on both sides of the air shield a labyrinth type sealing is located.

* * * * *